US009204676B2

(12) United States Patent
Gbadamosi

(10) Patent No.: US 9,204,676 B2
(45) Date of Patent: Dec. 8, 2015

(54) ATTACHABLE GARMENTS

(71) Applicant: Rakiat Layo Gbadamosi, New York, NY (US)

(72) Inventor: Rakiat Layo Gbadamosi, New York, NY (US)

( * ) Notice: Subject to any disclaimer, the term of this patent is extended or adjusted under 35 U.S.C. 154(b) by 229 days.

(21) Appl. No.: 13/964,850

(22) Filed: Aug. 12, 2013

(65) Prior Publication Data

US 2015/0040281 A1 Feb. 12, 2015

(51) Int. Cl.

| | |
|---|---|
| ***A41D 27/20*** | (2006.01) |
| ***A41D 15/00*** | (2006.01) |
| *A41B 1/06* | (2006.01) |
| *A41F 5/00* | (2006.01) |
| *A41F 7/00* | (2006.01) |
| *A41D 1/02* | (2006.01) |
| *A41D 1/06* | (2006.01) |

(52) U.S. Cl.

CPC ..... *A41D 27/201* (2013.01); *A41D 15/00* (2013.01); *A41B 1/06* (2013.01); *A41D 1/02* (2013.01); *A41D 1/06* (2013.01); *A41F 5/00* (2013.01); *A41F 7/00* (2013.01); *Y10T 24/45241* (2015.01)

(58) Field of Classification Search

CPC ..... A41D 27/04; A41D 5/00; A41D 7/00; A41D 1/18; Y10T 24/45241

See application file for complete search history.

(56) References Cited

U.S. PATENT DOCUMENTS

| | | | | |
|---|---|---|---|---|
| 1,897,261 | A * | 2/1933 | Killory | 2/117 |
| 2,163,053 | A * | 6/1939 | Norton | 24/683 |
| 2,325,494 | A * | 7/1943 | Fayer | 2/93 |
| 2,720,040 | A * | 10/1955 | Rogers | 36/2 R |
| 4,399,595 | A | 8/1983 | Yoon | |
| 4,561,121 | A * | 12/1985 | Ehring et al. | 2/455 |
| 4,633,527 | A * | 1/1987 | Ehring | 2/22 |
| 4,715,068 | A * | 12/1987 | Jacobson | 2/272 |
| 4,774,725 | A * | 10/1988 | Page | 2/81 |
| 4,947,489 | A * | 8/1990 | Greenwood | 2/304 |
| 4,959,876 | A * | 10/1990 | Kalaam et al. | 2/93 |
| D319,201 | S | 8/1991 | Aoki | |
| 5,123,120 | A * | 6/1992 | Ross | 2/229 |
| 5,136,724 | A * | 8/1992 | Grilliot et al. | 2/81 |
| 5,267,352 | A * | 12/1993 | Rodarmel | 2/44 |
| 5,604,960 | A | 2/1997 | Good | |
| 6,049,914 | A | 4/2000 | Heilman | |
| 6,170,088 | B1 | 1/2001 | Tate | |
| 6,223,352 | B1 * | 5/2001 | Watlington | 2/80 |
| 6,339,843 | B1 * | 1/2002 | Grilliot et al. | 2/97 |
| 6,389,600 | B1 * | 5/2002 | Di Maio | 2/121 |
| 6,434,801 | B2 | 8/2002 | Grunberger | |
| 7,065,841 | B2 | 6/2006 | Sjoquist | |
| 7,373,696 | B2 * | 5/2008 | Schoening et al. | 24/66.1 |
| 7,398,558 | B1 * | 7/2008 | Kattenhorn | 2/79 |
| 7,426,755 | B2 * | 9/2008 | Grilliot et al. | 2/81 |
| 7,621,001 | B2 | 11/2009 | Ebihara | |
| 7,793,518 | B1 | 9/2010 | Holleman | |
| 7,808,392 | B1 | 10/2010 | Anklesaria | |
| 2004/0154076 | A1 * | 8/2004 | Yoo | 2/247 |
| 2005/0278818 | A1 * | 12/2005 | Grilliot et al. | 2/69 |
| 2012/0117715 | A1 * | 5/2012 | Weafer | A41D 13/0015 2/228 |
| 2012/0204313 | A1 * | 8/2012 | Evans et al. | 2/70 |

* cited by examiner

*Primary Examiner* — Khaled Annis

(57) ABSTRACT

Garments releasably attachable to one another are provided. The present invention may include a first garment having a flap and a second garment have a slot. The flap may be formed to fit through the slot when the garments are being worn. The present invention may further include an attachment component that releasably attaches the flap with the second garment.

2 Claims, 3 Drawing Sheets

ATTACHABLE GARMENTS

BACKGROUND OF THE INVENTION

The present invention relates to attachable garments and, more particularly, to flaps of a first garment placed through slots of a second garment.

Clothing is fiber and textile material worn on the body. The wearing of clothing is mostly restricted to human beings and is a feature of nearly all human societies. Clothing performs a range of social and cultural functions, such as individual, occupational and sexual differentiation, and social status. In many societies, norms about clothing reflect standards of modesty, religion, gender, and social status. Clothing may also function as a form of adornment and an expression of personal taste or style. There exists a diverse range of styles in fashion, varying by geography, exposure to modern media, economic conditions, and ranging from expensive to traditional garb. Currently, many users desire to mix and match their clothing to express themselves and to also save money. However, most clothing is restrictive to the ability of mixing and matching. In today's fast paced, ever changing world of fashion, there is a societal need and pressure to keep up with changing fashion and with new "fads". In all social levels, there is a desire to keep up to pace with the "latest fashion". However, keeping up with this fast paced world of fashion can present an economic burden for most, as buying a new garment to keep up with every change in fashion can be quite costly.

As can be seen, there is a need for a clothing or apparel for mixing and matching, as well as attaching.

SUMMARY OF THE INVENTION

In one aspect of the present invention, an apparel comprises: a first garment comprising at least one flap; and a second garment comprising at least one slot, wherein at least one of the first garment and the second garment comprises a pocket below at least one of the at least one flap and the at least one slot; wherein the at least one flap is formed to fit through the at least one slot when the first garment and the second garment are worn.

In another aspect of the present invention, a method of connecting a first apparel with a second apparel comprises; providing a first garment comprising at least one flap; providing a second garment comprising at least one slot; wearing the first garment and the second garment, wherein the second garment overlaps the first garment; and placing the at least one flap through the at least one slot.

These and other features, aspects and advantages of the present invention will become better understood with reference to the following drawings, description and claims.

DETAILED DESCRIPTION OF THE INVENTION

Figure 1:
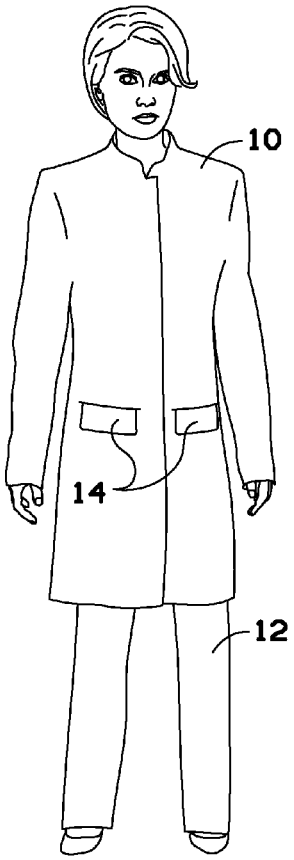
FIG. 1 is a perspective view of the present invention shown in use.
Figure 2:
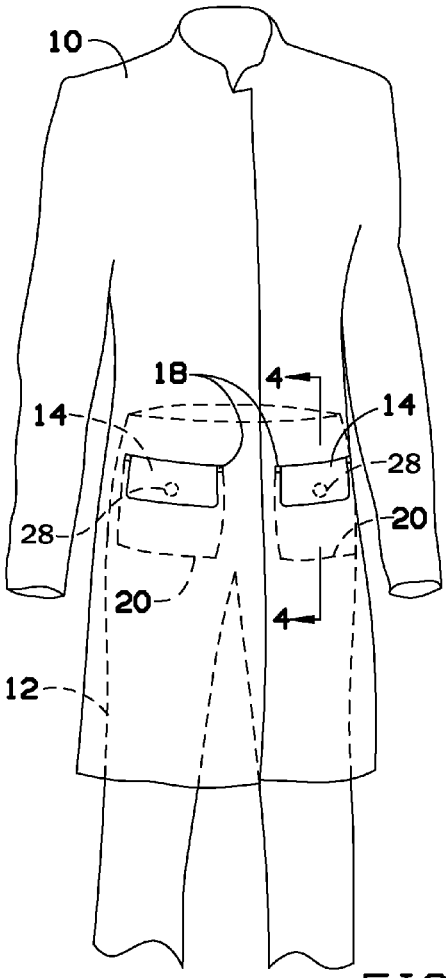
FIG. 2 is a perspective view of the present invention.
Figure 3:
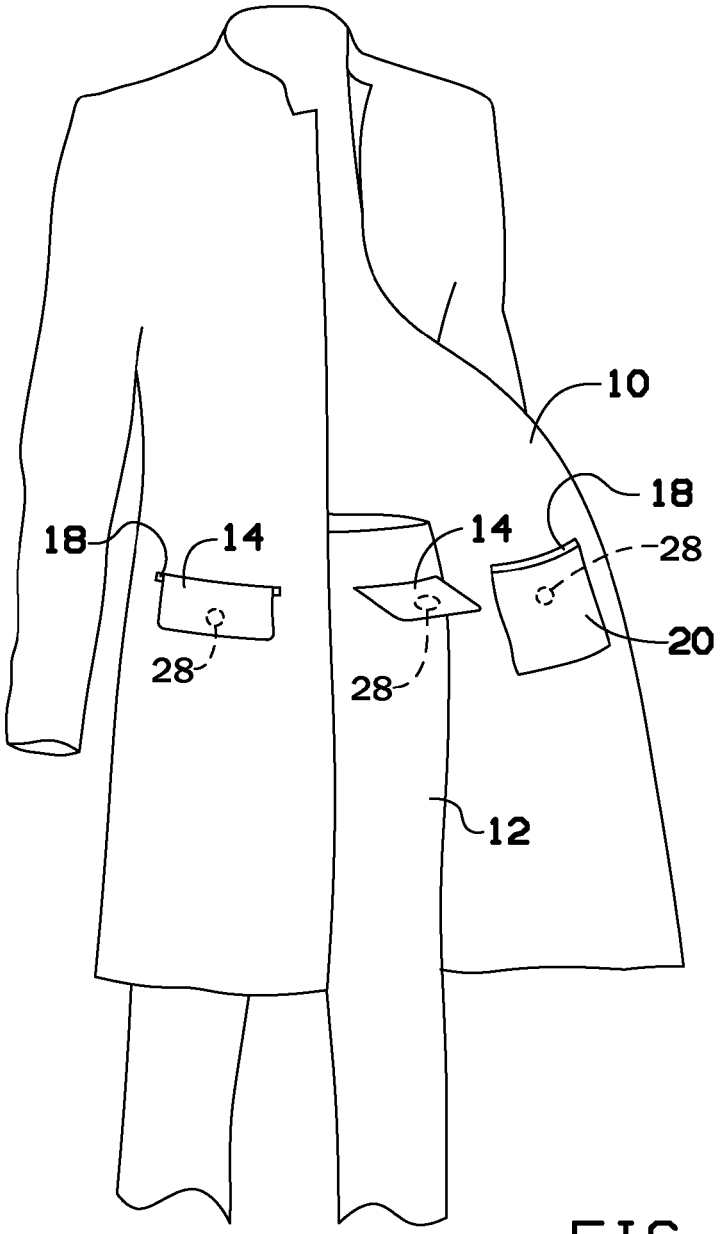
FIG. 3 is a perspective view of the present invention showing the inside of the second garment of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides garments that are releasably attachable to one another. The present invention may include a first garment having a flap and a second garment have a slot. The flap may be formed to fit through the corresponding slot when the garments are being worn. The present invention may further include an attachment component that releasably attaches the flap with the second garment.

The present invention may include connecting more than one garment together. The garments may be connected through a pocket insert and a pocket flap using an attachment component, such as magnets. The present invention may allow two separate garments to be worn as one garment. The user may mix and match different pieces in their wardrobe and update their wardrobe from season to season. In certain embodiments, a pocket flap of an inner garment may be inserted through the pocket insert of an outer garment. The outer garment and flap may include a magnet sewn into the lining. The flap may connect to the outer garment using the magnet. The garment may be worn separately by removing the flap from the insert.

The present invention may include a first garment 12, such as an inner garment, and a second garment 10 such as an outer garment. The first garment 12 may include at least one flap 14. For example, the first garment 12 may include two flaps 14. The flaps 14 may be sewn to the outer surface of the first garment 12. As illustrated, the first garment 12 may include pants. However, the first garment 12 is not limited to pants, and may be shorts, a skirt, a shirt, or the like. In certain embodiments, the first garment 12 may include a pocket 20 sewn below the flaps 14.

The second garment 10 may include at least one slot 18. For example, the second garment 10 may include two slots 18. The slot 18 may include an opening sewn into the second garment 10 that may run through the surface of the second garment 10. The at least one flap 14 of the first garment 12 may be formed to fit through the at least one slot 18 of the second garment 10. As illustrated, the second garment 10 may include a jacket. However, the second garment is not limited to a jacket and may be any outerwear, such as a sweatshirt, a blazer, a sweater, and the like. In certain embodiments, the second garment 10 may include a pocket 20. The pocket 20 may be sewn to an inside surface of the second garment 10 below the slot 18.

In certain embodiments, the present invention may include an attachment component 28. The attachment component 28 may include, but is not limited to, a magnet, a hook and loop fastener (Velcro®), a button, a clip, a zipper, snaps, and the like. The attachment component 28 may releasably attach the flap 14 to the second garment 10. An attachment component 28 may include a pair of components, one of which is attached to the flap 14 and the other corresponding component is attached to the second garment 10.

Figure 4:
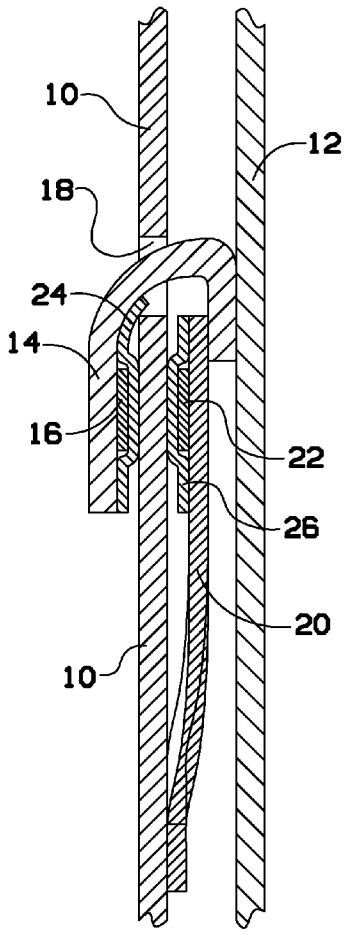
FIG. 4 is a section view of the present invention, taken along line 4-4 in FIG. 2.
Figure 5:
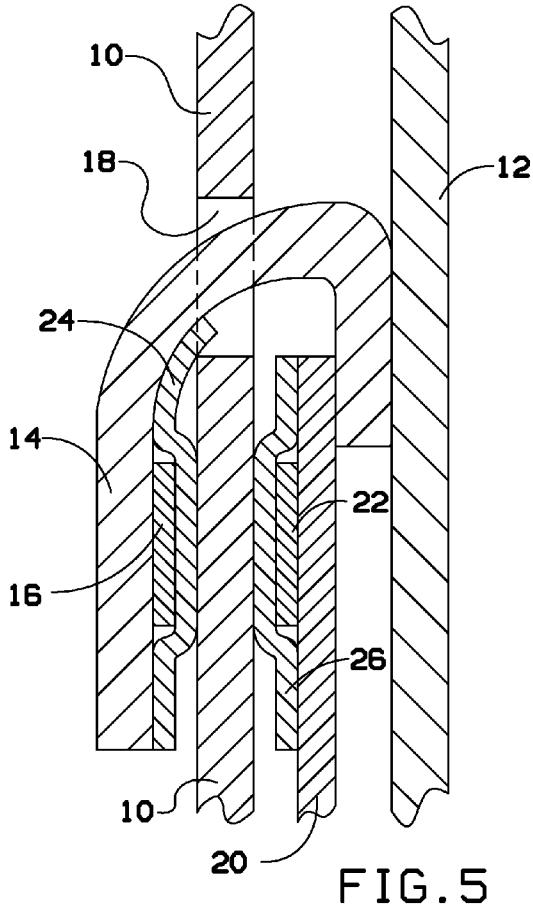
FIG. 5 is a detail section view of the present invention.

As illustrated in the FIGS. 4 and 5, the attachment component 28 may include a first magnet 16 and a second magnet 22. The first magnet 16 may be sewn in between the flap and the flap liner 24. The second magnet 22 may be sewn in between the pocket and an inner pocket liner 26 of the second garment 10. Therefore, a user may wear the first garment 12 and the second garment 10 and place the flap 14 through the slot 18. The user may then attach the two separate garments by attaching the first magnet 16 with the second magnet 22.

A method of connecting the first garment with the second garment may include the following: providing a first garment comprising at least one flap; providing a second garment comprising at least one slot; wearing the first garment and the second garment, wherein the second garment overlaps the first garment; and placing the at least one flap of the first garment through the at least one slot of the second garment. The user may then attach the attachment components together to further connect the first garment and the second garment to keep both garments in place.

The two garments may be sewn in the standard manner that garments are made. However, the slot or pocket insert on the second, outer garment may be placed on the same level as the pocket flap of the first, inner garment so that the pocket flap may be level with the pocket insert. The size of clothing being sewn may be taken into consideration. Users may be able to purchase various inner garments and outer garments and mix and match the pieces depending on their mood, the colors desired to be mixed together, the season, the latest styles that are "in vogue" and the patterns desired to be mixed together.

It should be understood, of course, that the foregoing relates to exemplary embodiments of the invention and that modifications may be made without departing from the spirit and scope of the invention as set forth in the following claims.

What is claimed is:

1. An apparel comprising:

a first garment formed and designed to fit on a lower part of a body and comprising at least one flap having a flap liner;

a second garment formed and designed to fit on an upper part of the body and comprising at least one slot and a pocket sewn to an inner surface of the second garment having an inner pocket liner;

a first magnet sewn in between the at least one flap and the flap liner; and a second magnet disposed below the at least one slot and sewn in between the pocket and the inner pocket liner;

wherein at least one of the first garment and the second garment comprises a pocket below at least one of the at least one flap and the at least one slot;

wherein the at least one flap is formed to fit through the at least one slot when the first garment and the second garment are worn to connect the first garment and the second garment keeping both garments in place.

2. The apparel of claim 1, wherein the first garment is pants and the second garment is a jacket.

* * * * *